US006187721B1

(12) United States Patent
Goldblatt et al.

(10) Patent No.: US 6,187,721 B1
(45) Date of Patent: Feb. 13, 2001

(54) LUBRICANT FOR USE IN DIESEL ENGINES

(75) Inventors: Irwin Goldblatt, Edison; Michael McHenry, Washington; Kenneth Henderson, Somerville, all of NJ (US); Danny Carlisle, Berkshire; Niall Ainscough, South Stoke, both of (GB); Myron Brown, Westfield; Richard Tittel, Jamesburg, both of NJ (US)

(73) Assignee: Castrol Limited, Wiltshire (GB)

( * ) Notice: Under 35 U.S.C. 154(b), the term of this patent shall be extended for 0 days.

(21) Appl. No.: 09/194,559

(22) PCT Filed: Jun. 10, 1997

(86) PCT No.: PCT/GB97/01556

§ 371 Date: Dec. 29, 1998

§ 102(e) Date: Dec. 29, 1998

(87) PCT Pub. No.: WO97/47709

PCT Pub. Date: Dec. 18, 1997

(51) Int. Cl.[7] ..... C01M 149/10

(52) U.S. Cl. ..... 508/221; 508/543; 525/279; 525/281; 525/282; 525/283; 525/293; 525/296; 525/309; 525/315

(58) Field of Search ..... 508/221, 543

(56) References Cited

U.S. PATENT DOCUMENTS

| | | | | |
|---|---|---|---|---|
| 4,144,181 | * | 3/1979 | Elliott et al. | 508/221 |
| 4,146,489 | | 3/1979 | Stambaugh . | |
| 4,507,515 | | 3/1985 | Johnston et al. . | |
| 4,632,769 | | 12/1986 | Gutierrez et al. . | |
| 4,693,838 | | 9/1987 | Varma et al. . | |
| 4,699,723 | | 10/1987 | Kapuscinski . | |
| 4,707,285 | | 11/1987 | Brewster et al. . | |
| 5,350,532 | | 9/1994 | Song et al. . | |
| 5,427,702 | | 6/1995 | Chung . | |
| 5,523,008 | * | 6/1996 | Boden et al. | 525/279 |
| 5,567,344 | * | 10/1996 | Emert et al. | 508/452 |
| 5,814,586 | * | 9/1998 | Boden et al. | 508/221 |

FOREIGN PATENT DOCUMENTS

WO 96 12746 5/1996 (WO) .

* cited by examiner

*Primary Examiner*—Margaret Medley
(74) *Attorney, Agent, or Firm*—Nixon & Vanderhye P.C.

(57) ABSTRACT

Soot in a lubricated diesel engine is effectively dispersed without adversely affecting the viscosity of the lubricant by using a particular lubricant. The lubricant utilized comprises a lubricant base stock (e.g. more than 75% by weight), a dispersant (e.g. from 0.2–less than 4% from a detergent inhibitor (D1) package), and a functionalized viscosity index improver (e.g. from 0.1–2.5% by solids weight). The functionalized viscosity index improver is a highly functionalized graft copolymer reaction product of an oxygen, a nitrogen, or an oxygen and nitrogen containing, ethylenically unsaturated, aliphatic or aromatic monomer having from 2 to about 50 carbon atoms grafted onto a polyolefin copolymer. Also, 0–2.5% by solids weight of another viscosity index improver besides the highly functionalized graft copolymer reaction product may be added, as well as other conventional additives.

10 Claims, No Drawings

LUBRICANT FOR USE IN DIESEL ENGINES

This application is a 371 of PCT/GB97/01556 dated Jun. 10, 1997.

The present invention concerns a lubricant for use in diesel engines, including passenger car and heavy duty commercial diesel engines.

Diesel engines produce soot as a by-product of the combustion process. The soot increases the viscosity of lubricants used in the diesel engines and eventually the lubricants become too thick to be workable. The soot therefore reduces the working life of the lubricants, and money and time are wasted in early replacement of the unworkable lubricant. The soot also causes wear of the diesel engines, which reduces their working life.

Lubricants currently on the market for diesel engines typically comprise: 65–80% by weight of base oil; 5–15% by weight of viscosity index improver(s) (VII); and 10–22% by weight of a detergent inhibitor (DI) package. The viscosity index improver(s) (VII) may be a non-dispersant viscosity index improver (NDVII) and/or a dispersant viscosity index improver (DVII). One function of the detergent inhibitor (DI) package is to provide a dispersant to disperse the soot and thereby prevent soot related viscosity increase of the lubricant and wear on the engine. The choice and amount of viscosity index improver(s) (VII) used in the lubricant, e.g. whether it is a NDVII or a DVII, will affect the choice and amount of dispersant, which is provided by the detergent inhibitor package (DI), present in the lubricant. In conventional formulations, the choice and amount of DI package is normally chosen to provide approximately at least:

a) 6% dispersant(s) in the finished lubricant when using a non-dispersant viscosity index improving agent (NDVII); or b) 4% dispersant(s) in the finished lubricant when using a traditional dispersant viscosity index improving agent (DVII), such as those available prior to approximately 1994.

Although it is possible to increase the amount of soot that is dispersed by a lubricant by increasing the amount of dispersant, which is provided by the detergent inhibitor (DI) package, present in the lubricant, increasing the amount of dispersant can cause the following negative effects: it can increase the wear on the engine by interfering with the anti-wear additives in the formulation; it can cause damage to seals in contact with the lubricant; it negatively impacts low temperature viscometrics; and it can increase the cost of the lubricant.

The inventors of the present invention are therefore concerned with the problem of increasing the amount of soot that is dispersed by a lubricant without increasing the amount of dispersant, which is normally provided by the detergent inhibitor (DI) package, present in the finished lubricant. The inventors are also concerned with the problem of controlling soot related viscosity increase with lower levels of dispersant, which is normally provided by the DI package, than conventionally used by those skilled in the art.

In accordance with the present invention there is provided use of a lubricant in a diesel engine to disperse soot produced by the diesel engine, the soot being dispersed without adversely affecting the viscosity of the lubricant; the lubricant comprising a dispersant and a functionalized viscosity index improver; the functionalized viscosity index improver comprising a highly functionalized graft copolymer reaction product of an oxygen, a nitrogen, or an oxygen and a nitrogen containing, ethylenically unsaturated, aliphatic or aromatic monomer having from 2 to about 50 carbon atoms grafted on to a polyolefin copolymer.

In accordance with the present invention there is also provided a method of controlling viscosity changes of a lubricant in a diesel engine that are caused by build-up of soot, the method comprising using the lubricant defined above as the lubricant in the diesel engine.

The inventors have found a lubricant that allows an increased amount of soot to be dispersed without increasing the amount of dispersant, which is normally provided by the detergent inhibitor (DI), present in the lubricant.

The inventors have also found a highly functionalized graft copolymer, which, when incorporated into a lubricant, allows the lubricant to disperse soot produced as a by-product of a diesel engine without adversely affecting the viscosity of the lubricant.

The inventors have also found that lower than conventional amounts (e.g. 4% or less) of dispersant, which is normally provided by the DI package, may be used in combination with the highly functionalized graft copolymer defined above to control soot related viscosity increase.

The inventors have also found that the lubricants of the present invention can comprise lower than conventional amounts (e.g. 4% or less) of dispersant, which is normally provided by the detergent inhibitor (DI), and still meet the current industry soot handling tests for passenger car and heavy duty commercial diesel engines.

By 'adversely affecting the viscosity of the lubricant', we mean increasing the viscosity of the lubricant to an unacceptable level, for example, a level defined in a standard industry test such as the Mack T8 Test.

Highly functionalized graft copolymers suitable for use in the present invention may be prepared using either a solution grafting process or a melt grafting process.

Preferred solution graft copolymers suitable for use in the present invention are disclosed in WO 96/12746, which was published on May 2nd 1996. The whole contents of WO 96/12746 are expressly incorporated into this patent application by reference thereto.

Other suitable graft copolymers may be prepared by grafting maleic anhydride on to the polyolefin copolymer and reacting the resulting succinic anhydride with an appropriate nitrogen containing moiety such as polyamine. Polyolefins grafted to the appropriate level may be prepared by following the practices disclosed in, for example, U.S. Pat. No. 144,181; U.S. Pat. No. 4,507,515; U.S. Pat. No. 4,557,847; U.S. Pat. No. 4,632,769; U.S. Pat. No. 4,693,838; U.S. Pat. No. 4,707,285; and U.S. Pat. No. 5,350,532. Suitable solution graft copolymers may be comprised of Mannich Base condensates.

WO 96/12746, the whole contents of which are hereby incorporated by reference thereto, discloses the reaction materials and reaction conditions that are needed to produce a preferred graft copolymer for use in the present invention. In particular, this document discloses the reaction materials and the reaction conditions that are needed to produce the graft copolymer reaction product and the viscosity index improving agent which can be used in the preferred lubricant of the present invention.

WO 96/12746, the whole contents of which are hereby incorporated by reference thereto, discloses: examples of preferred polyolefins that are suitable for use as a backbone for grafting; preferred graftable monomers that are suitable for being grafted on to the polyolefin backbone; and preferred initiators, solvents and inhibitors that are suitable for the grafting reaction.

WO 96/12746, the whole contents of which are hereby incorporated by reference thereto, also discloses suitable melt reaction conditions for producing the preferred grafted polyolefin by a melt reaction process.

WO 96/12746, the whole contents of which are hereby incorporated by reference thereto, also discloses test methods for determining: the proportions of nitrogen on the grafted copolymer and the process fluid (assuming the reaction is carried out in a process solvent); the amount of residual unreacted graftable monomer in a graft copolymer; the dispersancy of the graft copolymer; the UV/RI ratio; and the aromatic content of solvent or process fluid used in the solution grafting reactions.

WO 96/12746, the whole contents of which are hereby incorporated by reference thereto, also discloses details of the preferred: base oils; graft copolymers; non-grafted polyolefins; other dispersants; detergents; anti-wear agents; antioxidants; pour point depressants; and minor ingredients.

A preferred melt grafted copolymer for use in the present invention is PARATONE 8500, available from Exxon Chemical Company. U.S. Pat. No. 5,427,702 also discloses suitable melt grafted copolymers for use in the present invention. WO 96/12746 also discloses details of melt grafted copolymers for use in the present invention.

By 'highly functionalized graft copolymer reaction product', we preferably mean a graft copolymer reaction product that has at least 13 mole percent (based on a polymer having a molecular weight of 100,000) of monomer grafted on to the polyolefin copolymer. More preferably, about 20 to 30 mole percent or greater of monomer is grafted on to the polyolefin copolymer.

The highly functionalized graft copolymer reaction product preferably has either:

a) an ADT value of at least 8, more preferably at least 16, when it has been prepared using a solution grafting process; or b) an ADT value of at least 1 when it has been prepared using a melt grafting process. The ADT test is a method developed by The Rohm & Haas Company for determining the dispersancy of grafted dispersant polyolefins. Details of the test method can be found in the WO 96/12746, which was published on May 2nd 1996.

The highly functionalized graft copolymer preferably has the property of increasing the viscosity index of a lubricating base oil stock by at least 20 points when present at a level of 1% by weight of solids in the base oil stock.

The highly functionalized graft copolymer preferably comprises at least one of the following monomers grafted on to the polymer backbone:

N-vinylimidazole;
1-vinyl-2-pyrrolidinone;
N-vinyl imidazole;
N-allyl imidazole;
1-vinyl pyrrolidone;
2-vinyl pyridine;
4-vinyi pyridine;
N-methyl-N-vinyl-acetamide;
di-ailyl formamide;
N-methyl-N-allyl formamide;
N-ethyl-N-allyl formamide;
N-cyclohexyl-N-allyl formamide;
4-methyl-5-vinyl thiazole;
N-allyl di-iso-octyl phenothiazine;
2-methyl-1-vinylimidazole;
3-methyl-1-vinylpyrazole;
N-vinyi-purine;
N-vinyl piperazines;
N-vinyl succinimide;
Vinylpiperidines;
Vinylmorpholines;

and combinations of those materials.

The highly functionalized graft copolymer preferably comprises at least 1.2% by weight of N-vinylimidazole, grafted on to the polymer backbone.

The highly functionalized graft copolymer preferably comprises at least 1.2% by weight of suitable grafted monomers such as succinic anhydride or acid functionality such as fumaric acid which, after functionalizing the polymer backbone, is derivatised with morpholines, tetra pentamine, triethyl tetramine or other suitable amines or nitrogen containing moieties.

The highly functionalized graft copolymer reaction product preferably comprises a graft copolymer backbone having a weight average molecular weight of from 20,000 to 500,000 and a polydispersivity of less than 10.

The lubricating oil preferably comprises, lubricant base stock(s) (mineral, synthetic and mixtures thereof; a detergent inhibitor (DI) package; and the highly functionalized graft copolymer defined above. In addition, it may also comprise any standard commercial viscosity index improver (VII).

The lubricating oil preferably comprises:

A. more than 75% by weight of lubricant base stock(s);

B. from 0.1% to 2.5% by solids weight of the above mentioned highly functionalized graft copolymer; and C. from 0% to 2.5% by solids weight of any commercially available viscosity index improver; and D. from 1% to 20% by weight of a detergent inhibitor (DI) package.

The lubricant preferably comprises: from 0.1% to less than 10%, preferably from 0.2% to less than 7% by weight, more preferably from 0.2% to less than 4%, even more preferably from 0.2% to less than 2% by weight, of dispersant, which is normally provided by the DI package.

The lubricant may comprise the usual optional additives such as detergents, extreme pressure antiwear inhibitors, oxidation inhibitors, rust inhibitors, friction modifiers, foam inhibitors and other minor additives. Suitable additives can be found in WO 96/12746.

It should be clear to persons skilled in the art that WO 96/12746, the whole contents of which are incorporated herein by reference thereto, discloses the details of the highly functionalized graft copolymers that are suitable for use in the present invention to disperse the soot in diesel engines. The person skilled in the art should therefore read the present application in conjunction with WO 96/12746 and incorporate the whole contents of the document into the present patent application.

It should also be clear to persons skilled in the art that the applicants of the present application may expressly insert any one of the features disclosed in WO 96/12746, the whole contents of which are incorporated herein by reference thereto, into any one of the pending claims during prosecution of the present patent application, or into any one of the granted claims during post-grant amendment of the patent granted for the present patent application.

The invention will now be described with reference to the following examples:

EXAMPLES

WO 96/12746, the whole contents of which are hereby incorporated by reference thereto, discloses: specific examples of laboratory preparations of preferred grafted polyolefins; specific examples of pilot plant preparations of preferred graft copolymers; a specific example of a pilot plant preparation of a comparative graft copolymer; specific examples of preparations of preferred graft copolymers and a comparative graft copolymer; and specific examples of preparation of a preferred graft copolymer by extrusion. U.S. Pat. No. 5,427,702 also provides details for the preparation of preferred graft copolymers by extrusion. The person skilled in the art is therefore directed to WO 96/12746 and U.S. Pat. No. 5,427,702.

The following tests were conducted to show that lubricants falling within the present invention are capable of dispersing soot produced by diesel engines without adversely affecting the viscosity of the lubricant. All treat rates are given as percent weight.

Illustration of Passenger Car Diesel Soot Handling—BMW TDS

Test Procedure—BMW TDS 80 HOUR TEST

The BMW TDS test was carried out using a new type M51 engine for each series of tests. The engine was a 2.5 litre, 6 cylinder, turbocharged and intercooled indirect injection diesel engine. The engine was adapted for engine test bed operation. The modifications were made to the fuel system, the oil cooling system and the engine cooling system.

After the engine was installed ready for the test, a 7 hour break-in procedure was run. The break-in procedure was followed by an 80 hour reference test using a high quality, commercially available, fully synthetic engine oil. The BMW TDS test involved a 15 hour period of increasing engine speeds and loads, which was then repeated twice for a total of 45 hours running time. This was followed by a 5 hour period of low/medium speed with maximum load, followed by 5 hours of medium speed with maximum load. The test was completed by 25 hours at maximum engine speed and load. The test conditions are given below.

Following the reference test on a new engine, 4 candidate runs were conducted. Prior to each candidate, a comprehensive engine flush was performed to remove all traces of the previous oil. The candidates were compared to the reference run because the engine used in the test was not built to laboratory standards. Evaluation of each test was by sludge measurement, oil consumption and used oil analysis.

In the examples below, the detergent inhibitor (DI) package was constant, with the exception of the type and amount of dispersant present.

Example A1

A 15W50 oil was blended in Exxon base stocks with a NDVII (an unfunctinnalized olefin copolymer, Paratone 8002, available from Exxon Chemical Company). The level of dispersant (LZ6420, available from Lubrizol Corp.) present in the lubricant formulation was 6.5%.

Example A2

As for Example A1 except that the dispersant level was reduced to 1.5% in the finished lubricant and over half of the NDVII was replaced with a highly functionalized graft copolymer (0.88% weight by solids). The highly functionalized graft copolymer was the graft copolymer prepared in Example 10 of WO 96/12746.

Results

These are summarised in the tables below.

The results from Examples A1 and A2 were very similar, despite the fact that the level of dispersant in the finished lubricant was 6.5% in Example A1 but only 1.5% in Example A2.

Conclusion

These results show that use of the highly functionalized graft copolymer defined in the present patent application at 0.88% weight by solids provides the same dispersancy as the use of 5% dispersant, which is provided by the DI package, in the finished lubricant formulation. Therefore, the use of the highly functionalized graft copolymer makes it possible to control soot related viscosity increase in a lubricant in a diesel engine with a DI package comprising a much lower amount of dispersant.

BMW TDS TESTS

| | Composition of Lubricant | |
|---|---|---|
| Examples | A1 | A2 |
| NDVII | Olefin copolymer | Olefin copolymer |
| NDVII Code | Paratone 8002 (Available from Exxon Chemical Company) | Paratone 8002 (Available from Exxon Chemical Company) |
| Treat (%) | 13 | 6 |
| DVII | None | Graft copolymer |
| DVII Code | | Highly functionalised graft copolymer obtained in Example 10 of WO 96/12746 |
| Treat | | 8.8 |
| Graft Copolymer solids in oil (%) | None | 0.88 |
| DI package (%) | 11.25 | 6.25 |

-continued

| BMW TDS TESTS | | |
|---|---|---|
| | Composition of Lubricant | |
| Examples | A1 | A2 |
| Dispersant in DI package | LZ6420 (Available from Lubrizol) | LZ6420 (Available from Lubrizol) |
| Dispersant level in DI package (%) | 6.5 | 1.5 |
| Vis Grade | 15W50 | 15W50 |
| Exxon Stock | 75.75% | 78.95% |
| INSPECTIONS | | |
| Sludge merit (out of 10) | 8.8 | 8.6 |
| TBN change (%) | −22.73 | −18.52 |
| % Kvis, 100° C.,increase | 110.2 | 113.44 |
| Insolubles Increase (%) | 5.2 | 4.9 |

BMW 2.5 TDS TEST
BMW TEST CONDITIONS
Speed and Load Sites

| Line No. | Engine Speed | Torque nm | Step Duration (hours) | Cycle Test Times (hours) |
|---|---|---|---|---|
| 1 | 750 | 0 | 1 | 1,16,31 |
| 2 | 1,000 | 20 | 1 | 2,17,32 |
| 3 | 1,000 | 100 | 1 | 3,18,33 |
| 4 | 1,000 | WOT | 1 | 4,19,34 |
| 5 | 2,200 | 20 | 1 | 5,20,35 |
| 6 | 2,200 | 100 | 1 | 6,21,36 |
| 7 | 2,200 | 200 | 1 | 7,22,37 |
| 8 | 2,200 | WOT | 1 | 8,23,38 |
| 9 | 3,500 | 20 | 1 | 9,24,39 |
| 10 | 3,500 | 100 | 1 | 10,25,40 |
| 11 | 3,500 | 200 | 1 | 11,26,41 |
| 12 | 3,500 | WOT | 1 | 12,27,42 |
| 13 | 4,800 | 20 | 1 | 13,28,43 |
| 14 | 4,800 | 100 | 1 | 14,29,44 |
| 15 | 4,800 | WOT | 1 | 15,30,45 |
| 16 | TEST LOOPS BACK TO LINE 1. . .3 TIMES | | | |
| 17 | 2,000 | 100 | 5 | 50 |
| 18 | 3,000 | 100 | 5 | 55 |
| 19 | 4,800 | WOT | 25 | 80 |

Test end at 80 hours plus the power curve time (approx. 25 mins) plus the oil levelling times.

Oil samples to be taken at 50, 60, 70, 80 WITH ENGINE RUNNING.

OPERATING CONDITIONS

Listed in the attached table are the operating conditions for the final 25 hour endurance period of the BMW TDS Oil Thickening Test.

| Data Logging Frequency | (hourly) | minimum |
|---|---|---|
| Speed | (1/min) | 4800 ± 25 |
| Torque Output | (Nm) | 199–219 |
| Coolant Inlet Temperature | (° C.) | 90 approx. |
| Coolant Outlet Temperature | (° C.) | 100 ± 2 |

-continued

| Data Logging Frequency | (hourly) | minimum |
|---|---|---|
| Oil Gallery Temperature | (° C.) | 115 ± 2 |
| Boost Air Inlet Temperature | (° C.) | 30 Max |
| Fuel Consumption | (kg/hr) | 35 approx. |
| Oil Pressure | (Bar) | 4.1 approx. |
| Exhaust Smoke Number | (Bosch Index) | 2.5 maximum |
| Blowby Quantity | (1/min) | 83 approx. |
| Oil Consumption (over each stage) | (grams) | record |

Further Illustration of Passenger Car Diesel Soot Handling—The 'XUD11ATE' Engine Test The XUD11ATE engine test (CEC L-56-T-95) is a recently established European test for determining the ability of a lubricant to control viscosity changes caused by soot that is produced as a by-product from the combustion process of modern passenger car diesel engines. The XUD11ATE engine test is an integral part of the Association des Constructeurs Europeens D'Automobiles European Oil Sequences For Light Duty Diesel Engines. The test also evaluates sludge and piston cleanliness. A critical parameter is the viscosity increase in the lubricant at 3.0% soot in oil. The required level of soot must be achieved before the end of the test.

Example B1

A formulation similar to A2 was assessed in the XUD1 1ATE test as a 15W50 in BP stocks. The highly functionalised graft copolymer was PARATONE 8500 (available from Exxon Chemical Company) at 0.88% solids, with an additional 5% of NDVII (PARATONE 8002, an unfunctionalized olefin copolymer) to adjust the viscometrics. The DI package treat rate was 7.07%, which gave a dispersant level in the finished lubricant of 1.75%. The dispersant used in this Example was TLA1605X, available from The Texaco Additive Company.

The test results meet the European ACEA B2-96 requirements for this engine test. The viscosity increase at 3% soot was 182.8%, the piston merit 43.2 and the sludge rating was 9.50.

Example B2

The above test was repeated replacing the TLA 1605X with 7.07% of an alternative dispersant, OLOA 375C (available from The Chevron Chemical Company). The level of the dispersant in the lubricant was again at 1.75%.

The test results meet the European ACEA B2-96 requirements for this engine test. The viscosity increase at 3% soot was 195.1%, the piston merit 51.8 and the sludge rating was 9.57.

CONCLUSION

Use of the lubricant comprising the highly functionalized graft copolymer controls the soot related viscosity increase and allows the lubricant to meet the industry specification at unexpectedly low dispersant treat rates (1.75%).

Illustration of Heavy Duty Commercial Diesel Soot Handling—Mack T8 Test

The Mack T8 engine test is an established test for determining the ability of a lubricant to control viscosity changes caused by soot that is produced as a by-product from the combustion process of modern heavy duty truck diesel engines. The Mack T8 engine test is an integral part of the American Petroleum Institute's CG4 lubricant specification for on-highway trucks. The test also evaluates sludge and oil consumption. The critical parameter is the viscosity increase in the lubricant at 3.8% soot in oil, measured by Thermogravimetric analysis (TGA). The required level of soot may be achieved before the end of the test (250 hours). At the end of the test, the soot and viscosity increase are measured. These measurements are used as a measure of oil performance.

| Details of Mack T8 Test (ASTM 4485) | | |
|---|---|---|
| Equipment: | Mack E7-350, six cylinder turbocharged, intercooled diesel engine. 12.0 litres, 350 BHP. | |
| Purpose: | Evaluation of viscometric performance and soot loading of engine oils in turbocharged and intercooled diesel engines. | |
| Test Conditions: | Duration, hrs | 250 at full load |
| | Speed, rpm | 1800 |
| | Torque, lb/ft | 1010–1031 |
| | Oil sump temp, ° C. | 102–107 |
| | Coolant out temp, ° C. | 85 |
| | Fuel | 0.03–0.05% Sulphur |
| Method of Rating: | Viscosity increases from used oil in analysis are measured. Test method also stipulates max. oil consumption of 0.0005 lbs/BHP/hr. | |

In the examples below, we followed the Mack T8 Test (excluding the 3.8% requirement) to compare relative performance of Examples C1 and C2.

In the examples below, the detergent inhibitor package was constant and the amount of dispersant derived from the DI package was varied.

Example C1

A 15w40 was blended in Sun HPO Group 2 base stocks with a NDVII (an unfunctionalised olefin copolymer, Paratone 8011, available from Exxon Chemical Company). The level of dispersant used in the lubricant formulation was 4%.

Example C2

A 15w40 was blended in Sun HPO Group 2 base stocks with the highly functionalized graft copolymer obtained by following Example 10 of WO 96/12746. The level of dispersant derived from the DI package present in the lubricant formulation was 1%.

Results

These are summarised in the table below.

The results from Examples C1 and C2 are significantly different. At equivalent soot contents there are marked differences in the viscosity increase and soot particle sizes. Example C2, with the highly functionalized graft copolymer failing within the present invention (Example 10 of WO 96/12746), shows good viscosity control throughout the test. The average soot particle size is maintained at a relatively low value, which accounts for the lower viscosity increase. Example C2 also shows better sludge control.

Conclusion

These results show the use of a lubricant comprising the highly functionalized graft copolymer defined in the present application gives superior performance when compared to a conventional formulation which uses 3% more dispersant derived from a DI package in the finished lubricant formulation.

| Mack T8 Results | | | | | |
|---|---|---|---|---|---|
| Oil Code | Time | % Soot | Size (nm) | | Polydispersivity Index |
| | | | | Kvis, 100° C., Increase | |
| Example C1 | 50 hours | 1.2 | 163.4 | 0.69 | 0.24 |
| | 100 hours | 1.8 | 165 | 1.98 | 0.24 |
| | 150 hours | 2.4 | 177.5 | 4.27 | 0.51 |
| | 200 hours | 3 | 191.9 | 14.43 | 0.1 |
| | 250 hours | 3.6 | 186.4 | 38.55 | 0.06 |
| Average Rocker Cover Sludge | 7.6 | | | | |
| | | | | V100 Increase | |
| Example C2 | 50 hours | 0.8 | 146.9 | 0.3 | 0.14 |
| | 100 hours | 1.4 | 144 | 0.95 | 0.34 |
| | 150 hours | 2.3 | 135.3 | 1.54 | 0.141 |
| | 200 hours | 3 | 146.8 | 2.1 | 0.19 |
| | 250 hours | 3.6 | 142.3 | 2.41 | 0.05 |
| Average Rocker Cover Sludge | 8.12 | | | | |

What is claimed is:

1. A method of dispersing soot produced by a lubricated diesel engine, comprising lubricating the engine with a lubricating oil composition comprising more than 75% by weight of lubricant base stock, from 0.1–2.5% by solids weight said functionalized of a graft reaction product of a monomer selected from the group consisting of N-vinyl imidazole, 1-vinyl-2-pyrrolidinone, N-allyl imidazole, 1-vinyl pyrrolidone, 2-vinyl pyridine, 4-vinyl pyridine, N-methyl-N-vinyl-acetamide, di-allyl formamide, N-methyl-N-allyl formamide, N-ethyl-N-allyl formamide, N-cyclohexyl-N-allyl-formamide, 4-methyl-5-vinyl thiazole, N-allyl-di-iso-octyl phenothiazine, 2-methyl-1-vinylimidazole, 3-methyl-1-vinylpyrazole, N-vinyl-purine, N-vinyl piperazines, N-vinyl succinimide, vinylpiperidines, vinylmorpholines, and combinations thereof grafted onto an ethylenic polymer backbone, said graft copolymer having a weight of from 20,000 to 500,00 and a polydispersivity of less than 10 and a molar proportion of grafted monomer to the final polymer of at least about 13:1, from 0–2.5% by solids weight of an ungrafted dispersant viscosity index improver, and from 0.2-less than 4% dispersant from a detergent inhibitor (D1) package, and optionally other additives aside from dispersants and viscosity index improvers; so as to effectively disperse soot produced by the diesel engine without adversely affecting the viscosity of the lubricant; and wherein the said lubricant composition comprises lubricant base oil, graft copolymer and ungrafted dispersant polymer.

2. A method of claim 1 wherein said graft copolymer have amolecular weight of 100,000.

3. A method of claim 1 having from 0.2-less than 2% dispersant from a detergent inhibitor (D1) package.

4. A method of claim 1 wherein said monomer is at least 1.2% by weight of N-vinylimidazole grafted onto the polymer backbone.

5. A method of claim 1 wherein said monomer is at least 1.2% by weight of suitable succinic anhydride or fumaric acid which, after functionalizing the polymer backbone, is derivatized with a material selected from the group consisting of morpholines, tetra pentamine, triethyl tetramine, other armines, or other nitrogen containing moieties.

6. A method of claim 1 having a graft copolymer reaction product that has an ADT value of at least 8 and which has been prepared using a solution grafting process.

7. A method of claim 1 having a graft copolymer reaction product that has an ADT value of at least 16 and which has been prepared using a solution grafting process.

8. A method of claim 1 having a graft copolymer reaction product that has an ADT value of at least 1 and which has been prepared using a melt grafting process.

9. A method of claim 7 further comprising (b) changing the lubricant when there is 3.0% soot, or more, in the lubricant as measured by thermogravimetric analysis.

10. A diesel engine lubricant comprising:

more than 75% by weight of lubricant base stock;

from 0.1–2.5% by solids weight of a graft reaction product of a monomer selected from the group consisting of N-vinyl imidazole, 1-vinyl-2-pyrrolidinone N-allyl imidazole, 1-vinyl pyrrolidone, 2-vinyl pyridine, 4-vinyl pyridine, N-methyl-N-vinyl-acetamide, di-allyl formamide, N-methyl-N-allyl formamide, N-ethyl-N-allyl formamide, N-cyclohexyl-N-allyl-formamide, 4-methyl-5-vinyl thiazole, N-allyl-di-iso-octyl phenothiazine, 2-methyl-1-vinylimidazole, 3-methyl-1-vinylpyrazole, N-vinyl-purine, N-vinyl piperazines, N-vinyl succinimide, vinylpiperidines, vinylmorpholines, and combinations thereof grafted onto an ethylenic polymer backbone, said graft copolymer having a weight of from 20,000 to 500,00 and a polydispersivity of less than 10 and a molar proportion of grafted monomer to the final polymer of at least about 13:1, from 0–2.5% by solids weight of an ungrafted dispersant viscosity index improver product;

from 0.2-less than 2% dispersant from a detergent inhibitor (D1) package; and optionally other additives aside from dispersants and viscosity index improvers and wherein the said lubricant composition comprises lubricant base oil, graft copolymer and ungrafted dispersant polymer.

* * * * *